US005735155A

United States Patent [19]

Morton et al.

[11] Patent Number: 5,735,155

[45] Date of Patent: Apr. 7, 1998

[54] METHOD FOR MANUFACTURING PATTERNED TREAD PLATES

[75] Inventors: William C. Morton, Barrington; Jeffery W. Covert, Libertyville, both of Ill.

[73] Assignee: Morton Manufacturing Company, Libertyville, Ill.

[21] Appl. No.: 735,662

[22] Filed: Oct. 24, 1996

[51] Int. Cl.[6] ..... B21C 51/00

[52] U.S. Cl. ..... 72/14.8; 72/20.2; 72/325; 72/379.2; 72/403; 29/896.6

[58] Field of Search ..... 72/335, 399, 403, 72/20.2, 20.3, 372, 379.2, 14.8, 15.1, 15.2, 413, 473, 325, 327, 293, 295; 29/896.6, 163.6; 52/177, 180, 673, 675

[56] References Cited

U.S. PATENT DOCUMENTS

| | | | |
|---|---|---|---|
| 2,278,554 | 4/1942 | Morton . | |
| 2,326,963 | 8/1943 | Morton . | |
| 3,788,118 | 1/1974 | Joseph | 72/327 |
| 4,188,814 | 2/1980 | Dodge et al. | 29/896.6 |
| 4,235,089 | 11/1980 | Vecchi | 72/325 |
| 4,343,119 | 8/1982 | Bahnfleth | 29/896.6 |
| 4,736,610 | 4/1988 | Carroll et al. | 29/896.6 |
| 5,007,275 | 4/1991 | Voss | 72/327 |
| 5,144,709 | 9/1992 | Rooney | 72/379.2 |

FOREIGN PATENT DOCUMENTS

| | | | |
|---|---|---|---|
| 4294823 | 10/1992 | Japan | 72/335 |

*Primary Examiner*—Lowell A. Larson
*Assistant Examiner*—Ed Tolan
*Attorney, Agent, or Firm*—Tilton, Fallon, Lungmus & Chestnut

[57] ABSTRACT

A method for manufacturing patterned tread plates including the steps of providing a press having a path for advancing a sheet therethrough, the press being equipped with a progressive die including a plurality of gaggable dies and punches arranged in a plurality of rows in the path to sequentially engage the sheet when the same is being advanced therethrough in the path, operably associating with the press a CPU having a large capacity secondary data storage device, introducing a multiplicity of codes into the secondary data storage device with each code corresponding to a different tread pattern, some of the codes including gagging instructions for the operation of the dies and punches, selecting a first set of codes and operating the CPU to control the press so as to optionally produce a predetermined number of tread plates according to the first set of codes, and thereafter selecting a second set of codes and operating the CPU to produce a predetermined number of tread plates having a different pattern than the tread plates formed according to the first set of codes.

2 Claims, 3 Drawing Sheets

METHOD FOR MANUFACTURING PATTERNED TREAD PLATES

FIELD OF THE INVENTION

This invention relates generally to a manufacturing method for metal tread plates and, more particularly, to an improved method for controlling presses used in the manufacture of metal tread plates having raised dome-shaped bosses for traction and open portions having downwardly-formed walls to facilitate drainage.

BACKGROUND

Tread plates are typically used in a wide variety of industrial settings such as on catwalks, truck beds, railroad freight cars, stairwells, and fire escapes. Tread plates are advantageous because they provide traction even in slippery conditions. Since the early 1940's, as shown in co-owned U.S. Pat. Nos. 2,278,554 and 2,326,963, it has been known to make tread plates having dome-shaped upwardly formed bosses having central perforations to provide traction, and open portions having downwardly-formed walls to add structure and to drain unwanted debris such as oil, water, snow, ice, and dirt. One such widely-employed tread plate is the OPEN-GRIP® tread plate of Morton Manufacturing Company, Libertyville, Ill.

In order to expand the versatility of tread plates and the like, it is desirable to manufacture the plates in different patterns or configurations, as appropriate for different environments. For example, the tread plates for steps in a straight staircase; those for steps in a winding staircase; those for a booster step on a railroad freight car; those for a running rail on a truck; or those for the corner of a catwalk, each require different configurations, although the general shape of the individual treads can be the same for all these applications.

Early machine production of the OPEN-GRIP® and similar tread plates required operators to set the dies of a press for making a row of treads in whatever configuration was called for by the particular application for which the plate was to be used. This was a painstaking process because it required resetting the dies after forming each row of treads. There were also dangers associated with operators having to repeatedly climb into the press to reset the dies.

Developments in manufacturing technology made it possible to operate the dies of the press via pneumatic valves, and eventually to electronically control the pneumatic valves. By storing signals in an analog format on perforated tapes and feeding the tapes through a processor, a signal could be sent to the electronic controls and in turn, the pneumatically operated dies could either be actuated or, alternatively, prevented from actuating. This prevention is known in the art as "gagging". Although it became possible to store enough codes on a single perforated tape such as numeric control (NC) punched paper tape to store a pattern for repeatedly manufacturing an entire tread plate in a desired configuration, the tape format had several drawbacks. First, it took a great deal of time to load a particular tape. Unless a continuous loop is created, the tape had to be rewound after it was finished. Even today, there are risks that the tape may become tangled. Also, if a different pattern is desired for producing a tread plate, it is necessary to unload the tape and load a new tape containing coding corresponding to manufacturing the different configuration. Downtime due to unloading and loading tapes is costly for manufacturing and also reduces overall production capacity. Another drawback is that analog tape has very limited storage capacity compared with other data storage formats. As a result, complex tread plate patterns require extremely long lengths of tape.

Therefore, it is one object of the present invention to provide an improved method for manufacturing tread plates that facilitates retrieval of stored codes for signalling electronically-controlled pneumatic dies. It is a further object of the present invention to provide an improved method for manufacturing tread plates that permits storage of codes for multiple patterns of tread plates so as to reduce downtime between production of tread plates having different tread configurations. It is still another object of the invention to provide a method of manufacturing tread plates that provides an operator-friendly interface to select among a set of stored codes to manufacture desired tread patterns. The manner in which these and other objects of the invention are accomplished will be explained in the following Summary of the Invention, Description of the Drawings, Detailed Description of the Invention, and the appended Claims.

SUMMARY OF THE INVENTION

The improved manufacturing method of the present invention comprises the use of a Central Processing Unit (CPU) having large capacity data storage means including a large capacity secondary data storage device, such as a hard disk drive, floppy disk drive or CD-ROM, in combination with a press and progressive die. The progressive die includes several rows of pneumatically operated dies and punches, with the pneumatic valves which actuate the dies and punches being electronically controlled.

The manufacture of each row of treads for a particular tread plate having the OPEN-GRIP® or similar tread shape involves performing a minimum of four press operations on a metal sheet, which can advantageously be performed in an in-line fashion so as to manufacture an entire tread plate with a single pass of the sheet through the press. Although it will be recognized that the order of operations for manufacturing tread plates having the OPEN-GRIP® tread shape, or similar-shaped tread, is not critical, the preferred embodiment of the invention is to perform the operations on a sheet in the following order: First, extrude a row of a repeating pattern of dimples to form a raised anti-slip traction surface comprising dome-shaped buttons on the sheet; second, pierce holes in the apex of each of the dome-shaped buttons; third, pierce a row of relatively large holes inside the button patterns; and fourth, extrude a boss around the perimeter of each of the relatively large holes so as to create downwardly-sloping drainage holes in the tread plate. These drainage holes are referred to in the art as "debossed holes".

By selectively preventing any particular operation from being performed on a portion of the sheet, i.e. by gagging a selected die or punch, tread plates can be manufactured with almost any selected configuration of the basic tread pattern desired. In the method of the present invention, storage of code data is in a large capacity secondary data storage medium or device, such as on a hard disk drive, floppy disk drive, or CD-ROM format. A CPU is used to process the data and send signals through a set of input/output (I/O) switches to electronically controlled pneumatic valves which operate in conjunction with the dies and punches on the progressive die of the press. Once interpreted, the stored data can be used to control production of any stored pattern of treads having the OPEN-GRIP® or similar shape.

The increased storage capacity of such secondary data storage media as a hard disk permits codes for multiple patterns of tread plates to be stored in one place. Depending on the maximum storage capacity of the hard disk employed, it is possible to store codes corresponding to several thousand tread plate patterns on a single hard disk. With the ability to store thousands of different patterns in one place, there is presented the opportunity to permit an operator to select a desired pattern from those available. As explained in more detail below, the present invention provides an on-screen operator interface on which the operator may select a particular pattern or series of patterns desired to be manufactured on a particular run through the press. Furthermore, several different patterns of treads may be manufactured on a single sheet during one pass through the press simply by selecting the proper order of codes on the operator interface.

DETAILED DESCRIPTION OF THE INVENTION

Figure 1:
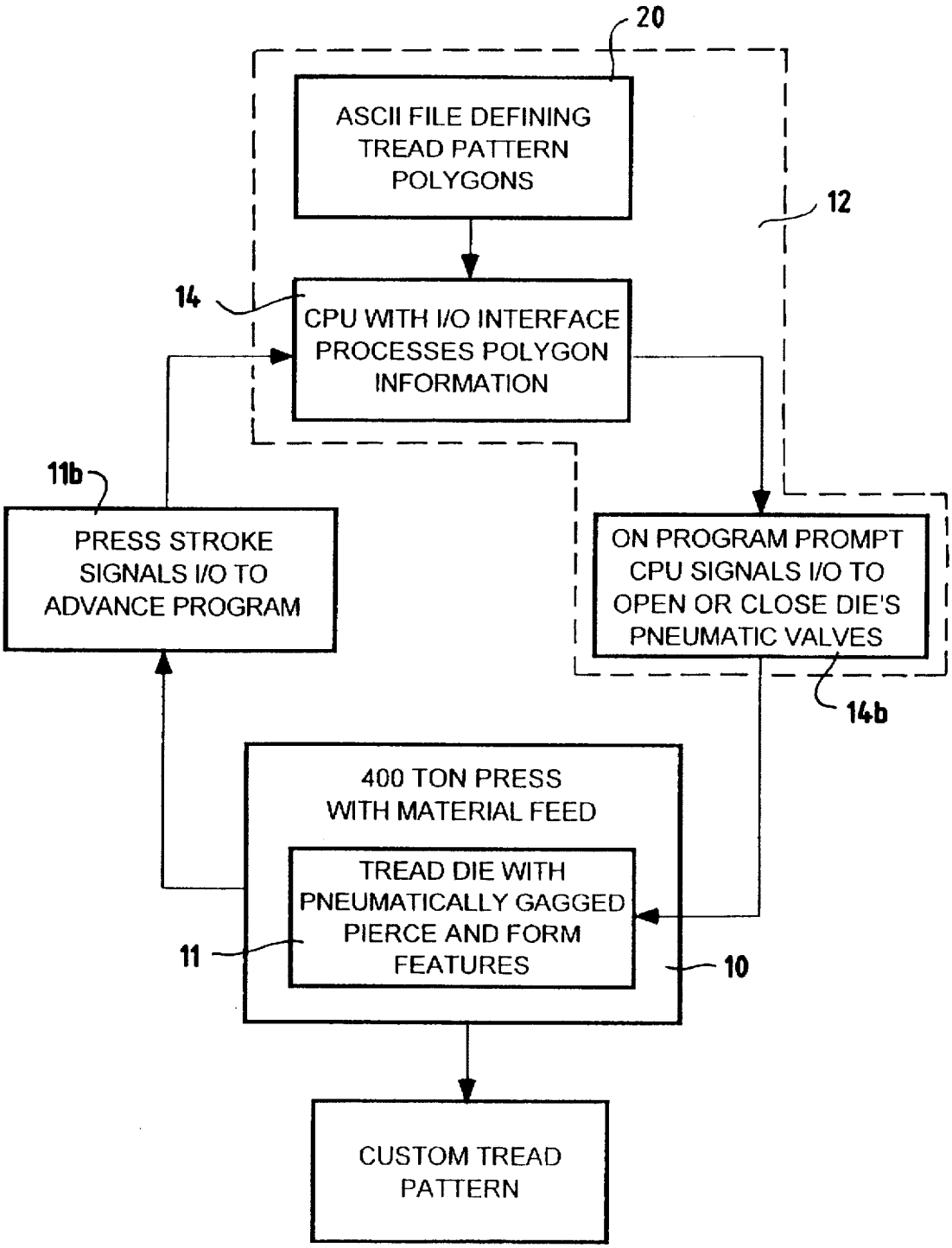
FIG. 1 is a flow diagram demonstrating the path of control operations which occur during the method of the present invention.
Figure 2:
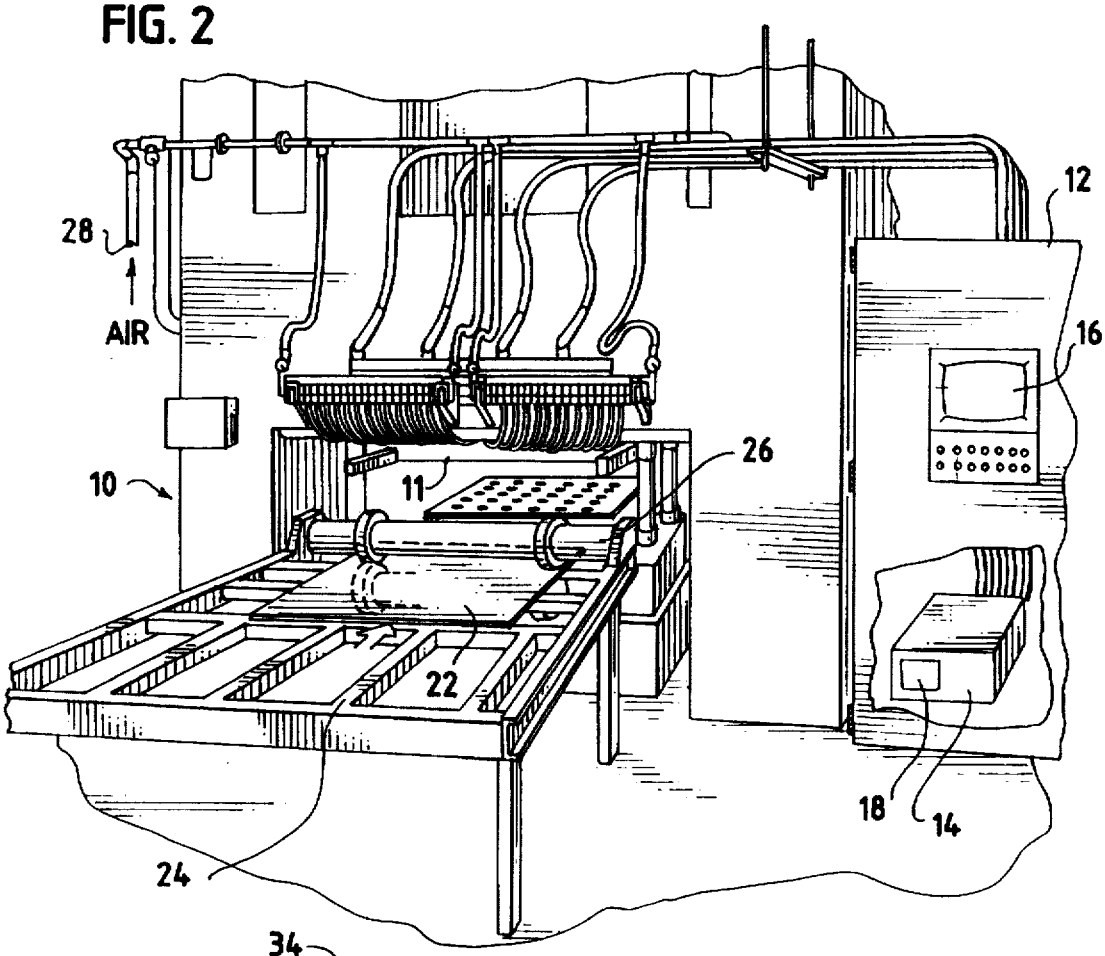
FIG. 2 is a perspective view of a press and operator interface unit, with the interface unit partially cut away, the press showing a partially manufactured patterned tread plate.

Referring to FIGS. 1 and 2, a press 10 having a progressive die 11 is shown in combination with an operator interface unit 12. The operator interface unit 12 contains a control processing means in the form of a Central Processing Unit (or CPU), 14, an operator interface 16, which can be in the form of a touch-sensitive screen or a screen monitor in conjunction with a key pad or the like, and a set of electronically controlled input/output (I/O) switches (not shown) which receive signals from the CPU and relay signals to open or close pneumatic valves on the press. The CPU 14 shown includes secondary data storage means comprising a large memory capacity hard disk drive 18, such as a disk drive having at least 1 Gigabyte of memory. The hard disk drive 18 stores computer data files 20 including sets of ASCII codes which correspond to different patterns for tread plate polygons to be manufactured on the press 10.

To further facilitate production, each data file may be referenced by part number or name which the operator, when prompted, may then enter into the operator interface 16 in order to call up the desired data file and manufacture the corresponding patterned tread plate polygon on the punch press. It is recognized that alternative high capacity SDS may be used, such as CD-ROM devices or floppy disk drives. Data files for different sets of tread plate patterns could be stored on interchangeable storage media.

After the operator enters a selection of tread plates to be manufactured, the CPU 14 processes the selection, accesses the corresponding data file 20 from the hard disk drive 18 and commences a computer program to convert the codes from the data file into an electronic signal sent to the I/O switches to selectively open or close pneumatic valves which, in turn, actuate the dies and punches of the press 10. It is recognized that any or all of the steps of prompting the operator for a selection or set of selections, processing the selection(s), and accessing the data file 20 may likewise be integral steps of the computer program.

A metal sheet 22 rests on a feed table 24 and is automatically fed through the press 10 by a customary method, such as a system by which transverse motion of the progressive die 11 of the press 10 actuates a roller 26, which is in communication with the metal sheet 22, and imparts translational motion of the sheet 22 through the press. The roller 26 is advantageously calibrated to advance, i.e., index, the sheet 22 a predetermined distance with each stroke of the press in order to properly position the sheet relative to each of four stations of the progressive die of the press 10.

Air for controlling the pneumatic valves of the progressive die 11 enters through an air inlet 28—see the upper left of FIG. 2. In conventional fashion dies and punches are located both above and below the sheet 22. At the first station, positioned above the sheet 22, (there is a row of relatively small dies with dome-shaped tips grouped in an arrangement so as to form rows of dimples or buttons B in hexagon formations Hex on the sheet 22 in order to form a raised tread surface comprising dome-shaped buttons on the sheet)—see, for example, FIG. 5. Although the dome-shaped buttons are formed downward, the progressive die is relieved from the sheet 22 while the sheet is indexed through the press 10 so the buttons B do not impede the forward progress of the sheet as it advances along the feed table 24. During the up-stroke of the progressive die, the roller 26 causes the sheet 22 to advance so as to position the sheet so that the row of just-formed dome-shaped buttons is at the second station and a fresh portion of the sheet is at the first station.

At the second station, punches located above the sheet pierce small holes h in the dome-shaped buttons B formed at the first station. The sheet next advances in the manner just described so that the row of pierced dome-shaped buttons is positioned at the third station of the progressive die. At the third station, punches above the sheet pierce a row of relatively large holes H, with one hole in the center of each of the hexagon dome-shaped button formations. Simultaneously, the first two stations perform their respective operations on trailing portions of the sheet 22. In the same manner, the sheet again advances so that the row of now-formed treads is positioned at the fourth station.

Figure 3:
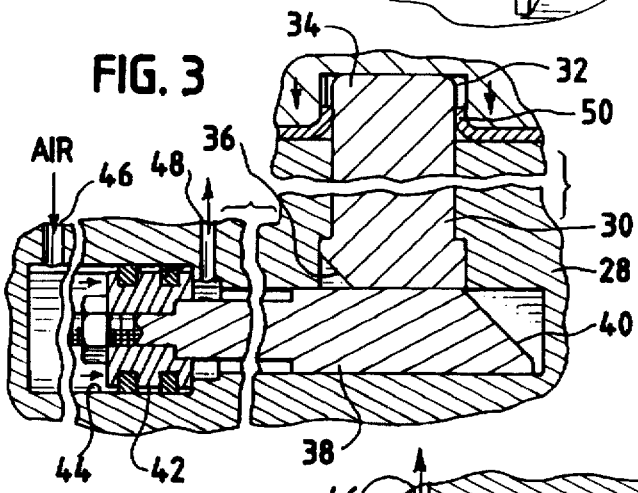
FIG. 3 is a segmented side view, partially broken away, of a pneumatic die unit shown extruding a boss around the perimeter of a hole formed in a metal sheet passing through the press shown in FIG. 2.

Referring now to FIG. 3, at the fourth station a lower housing 28 for a row of extrusion dies 30 is positioned below the sheet. As will be understood by those skilled in the art, the dies and punches in the first three stations operate in the same manner as the extrusion dies 30, although their ends have different shapes and sizes, thus detailed descriptions of all of the die and punch operations would be repetitive and therefore is omitted. Each extrusion die 30 includes a rounded or chamfered end 32, an elongated punching section 34, and a slanted bearing surface 36 for engagement by a gagging bar 38 along the gagging bar bearing surface 40.

In the preferred embodiment of the present invention, the gagging bar 38 is threadedly connected to an air driven piston 42 seated in a pneumatic cylinder or air chamber 44. When the related I/O switch receives a signal from the CPU 14 and opens the pneumatic valve corresponding to the air chamber 44 in a particular extrusion die, air enters the air chamber 44 through a die-firing air port 46 and air pressure forces the piston 42 to advance the gagging bar 38 to the FIG. 3 orientation. Air on the other side of the piston 42 is forced out of the die-gagging port 48. Such gagging bar-piston assemblies are present in each die and punch of the progressive die 11 of the press, including the dies and punches located above the sheet 22.

The gagging bar 38 engages the extrusion die 30 along the slanted bearing surfaces 36, 40 and the extrusion die 30 forms a boss 50 in the metal sheet 22 by pressing metal around the perimeter of a hole 52 previously pierced in the sheet 22 at the third station, as previously explained, into an extrusion chamber or boss cavity 54 located above the sheet on the upper progressive die housing 56 of the press 10.

The bosses 50 are formed upwards on the sheet 50 so the bosses 50 do not impede the movement of the sheet 22 along the feed table 24. In the finished tread plate, the dome-shaped buttons provide raised treads for an anti-slip or gripping surface and the bosses 50 cooperate with the pierced holes 52 to form downwardly-sloping drainage holes. Thus, in the preferred embodiment, the tread plate is manufactured upside down.

Figure 4:
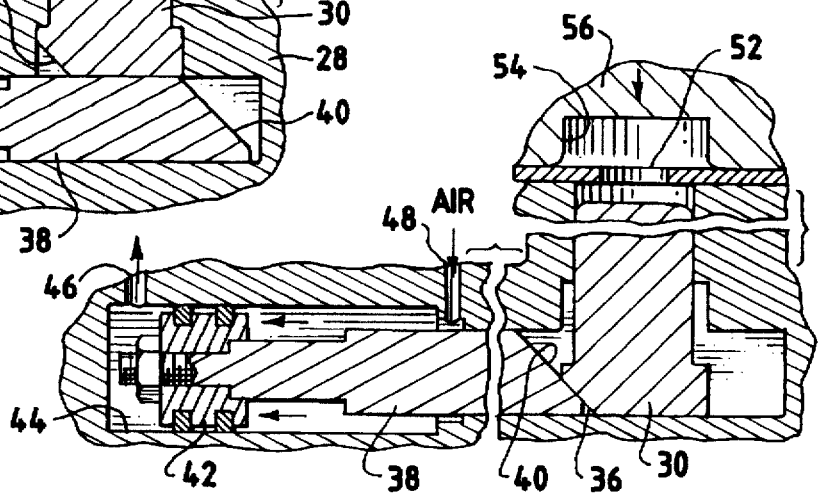
FIG. 4 is a segmented side view, partially broken away, of a pneumatic die unit in a gagged state.

Advantageously, as pointed out above, the present invention further includes a die-gagging air port 48 for each air chamber 44—see FIG. 4. When the extrusion die 30 fires, the die-gagging air port serves as an exit for air forced through the air chamber 44 by the die-firing air port 46 and the piston 42. By reversing the direction of air flow, the die-gagging air port may be used to return the piston 42, gagging bar 38, and extrusion die 30 to their unfired position. In addition, the die-gagging air port 48 is used to prevent the extrusion die 30 from firing, which is known as "gagging" the die. Gagging the die is significant in forming desired patterns of tread plates. Gagging is accomplished by the CPU receiving and interpreting a code from the data file 20 stored on the hard disk drive 18 which includes an instruction to gag a selected die or set of dies, then sending a signal to the I/O switch resulting in opening the pneumatic air valve for the die-gagging air port 48 corresponding to the selected die. Excess air in the air chamber 44 exits through the die-firing air port 46. The direction of air flow in the air chamber biases the piston 42 and the gagging bar 38 away from the extrusion die 30 so the bearing surface 36 of the extrusion die 30 rests on the lower part of the gagging bar bearing surface 40 and ultimately the bottom 58 of the extrusion die 30 rests on the bottom wall 60 of the gagging bar recess, thereby preventing the extrusion die 30 from firing.

Gagging of the dies and punches at the first, second, and third stations occurs in a similar manner. Thus, by selecting the proper data file 20 using the operator interface 16, any particular pattern of tread plate for which there is a stored data file, for example those shown in FIGS. 5–7, may be selectively manufactured. An operator may also use the operator interface 16 to enter commands to manufacture various patterns in a single sheet. It is recognized that once the sheet completes its pass through the punch press, further processing to cut and form the individual tread plates is required. The specifics of such post-processing, however, is well-known in the art and not critical to a description of the present invention.

EXAMPLE

Figure 5:
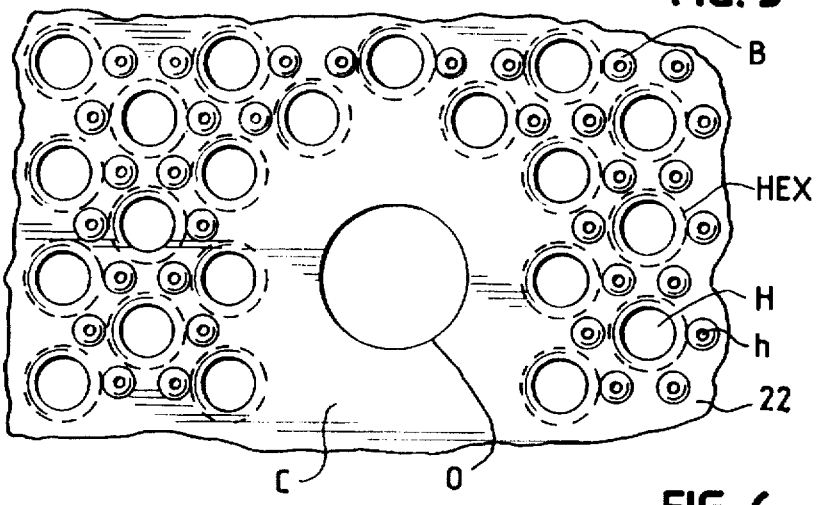
FIG. 5 is a top plan view, broken away, of a patterned tread plate formed using the method of the present invention.

As a specific example of the invention, a press 10 having a progressive die 11 with two rows of forty-eight dies each and two rows of forty-eight punches each was employed. Referring to FIG. 5, it will be noted that in the central space C, a number of dies and punches have been gagged to provide the space C. Then, after the sheet 22 issues from the press 10, the large opening O is made in the central space C in a conventional manner.

Figure 6:
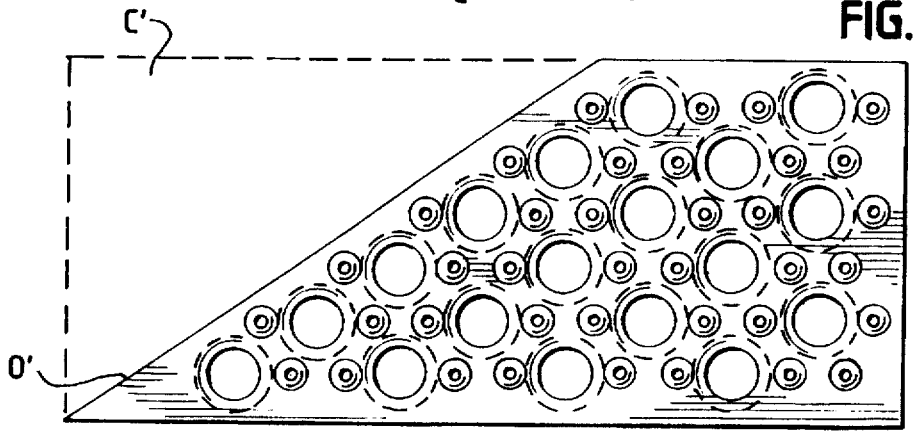
FIG. 6 is a top plan view of an alternative patterned tread plate formed using the method of the present invention.

In similar fashion, the sheet 122 of FIG. 6 is manufactured by having a number of dies gagged to provide a flat, i.e., untextured area C' at the upper left. After completion of the punching, the dashed-line area is trimmed along the line O' to remove the untextured space C'.

Figure 7:
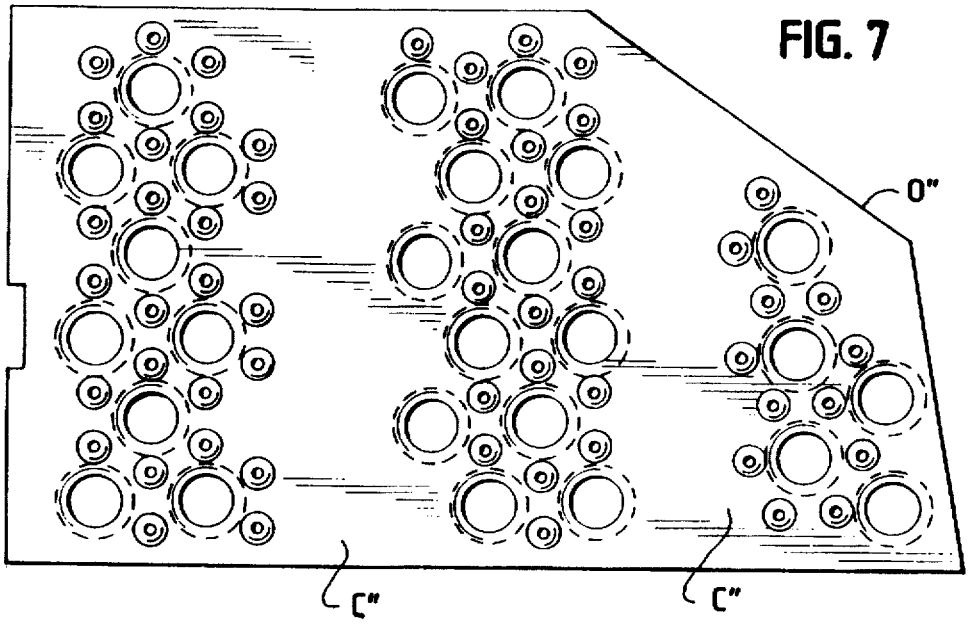
FIG. 7 is a top plan view of another alternative patterned tread plate formed using the method of the present invention.

Again, as can be appreciated from FIG. 7, flat, untextured spaces C" are achieved by gagging appropriate dies and the tread plate may be trimmed as at O" in order to provide a desired contour.

SUMMARY

The inventive method includes the steps of (a) providing a press 10 having a path for advancing a sheet therethrough, the press being equipped with a progressive die including plurality of gaggable dies and punches arranged in a plurality of rows in the path to sequentially engage the sheet when the same is being advanced therethrough in the path, (b) operably associating with the press a CPU having a large capacity secondary memory storage device, (c) introducing a multiplicity of codes into the secondary data storage device with each code relating to a different tread pattern, some of the codes including gagging instructions for the operation of the dies and punches, and (d) selecting a first code and operating the CPU to produce a predetermined number of tread plates according to the first code.

Step (a) correlates with box 10 of FIG. 1 wherein the identification is for a 400 TON PRESS WITH MATERIAL FEED, viz., the wheels 26 for advancing a sheet 22 along a generally horizontal, linear path along the feed table 24. The press is equipped with a plurality of dies and punches as indicated in the sub-box 28 which points out that there is a tread die with pneumatically gagged pierce and form features.

Step (b) relates to the box designated **14*b*** which relates to the CPU and is entitled ON PROGRAM PROMPT CPU SIGNALS I/O TO OPEN OR CLOSE DIE'S PNEUMATIC VALVES.

In the block diagram of FIG. 1, boxes prior to that designated **14*b* are designated 20 and 14, respectively. Box 20, entitled ASCII FILE DEFINING TREAD PATTERN POLYGONS relates to codes in a file defining tread pattern polygons (or the like). Box 14, entitled CPU WITH I/O INTERFACE PROCESSES POLYGON INFORMATION represents a CPU with a multiplicity of input/output interfaces which processes polygon information. These have to do with the instructions given to the operator who is normally positioned adjacent the interface unit 12 (see FIG. 2) which permits him/her to select a particular pattern or series of patterns to be manufactured. This selection is performed according to the boxes at the top of FIG. 1 and when the program is started, the boxes 14*b*, 10/11 and 11*b* come into play to automatically develop the CUSTOM TREAD PATTERN (FIGS. 5–7), where box 11*b*, entitled PRESS STROKE SIGNALS I/O TO ADVANCE PROGRAM, represents the return stroke of the progressive die or tread die 11** which signals the program to advance so that a new tread plate having either the same or a different tread pattern may be formed.

A further merit of the invention is the ability to develop several different patterns of treads in sequence on a single sheet during one pass through the press 10.

Although the details of the present invention have been set forth with respect to certain embodiments thereof, those skilled in the art will understand that it is not intended to be limited thereto and that changes and modifications can be made therein within the scope of the appended claims.

We claim:

1. A method for manufacturing patterned tread plates comprising the steps of:

providing a press having a path for advancing a sheet therethrough, said press being equipped with a plurality of selectively gaggable dies and punches arranged in a plurality of rows in said path to sequentially engage said sheet when the same is being advanced therethrough in said path, operably associating with said press a CPU having large capacity data storage means, introducing a multiplicity of sets of codes into said data storage means with each set of codes corresponding to a different tread pattern, some of said codes including select gagging instructions for the operation of said dies, providing an operator/CPU interface and entering a first code set selection signal into said interface, and operating said CPU to produce a predetermined number of tread plates according to said first code set, said press dies and punches being arranged in at least four rows with a plurality of dies or punches in each row, the first row comprising dies shaped and arranged to form spaced apart buttons in said sheet, the second row comprising punches being arranged to punch holes in the previously developed buttons, the third row comprising punches being arranged to punch holes in the spaces between said buttons, and the fourth row comprising dies being shaped and arranged to emboss the perimeter of each of the holes developed by said third row of punches.

2. The method of claim 1 in which said rows of dies and punches are operated in sequence as said sheet is indexably advanced along said path, said first code set being equipped with instructions to operate said first row of dies to produce a selected geometric arrangement of said buttons.

* * * * *

UNITED STATES PATENT AND TRADEMARK OFFICE

CERTIFICATE OF CORRECTION

PATENT NO. : 5,735,155

DATED : April 7, 1998

INVENTOR(S) : William C. Morton, et al

It is certified that error appears in the above-indentified patent and that said Letters Patent is hereby corrected as shown below:

Column 7, line 23, change "select" to -- selective --.

Signed and Sealed this

Sixteenth Day of June, 1998

*Attest:*

*Attesting Officer*

BRUCE LEHMAN

*Commissioner of Patents and Trademarks*

UNITED STATES PATENT AND TRADEMARK OFFICE

CERTIFICATE OF CORRECTION

PATENT NO. : 5,735,155

DATED : April 7, 1998

INVENTOR(S) : William C. Morton, et al

It is certified that error appears in the above-indentified patent and that said Letters Patent is hereby corrected as shown below:

Column 3, line 50, after "secondary data storage", insert -- (SDS) --

Figure 2 should include a reference number 122 and corresponding lead line pointing to the sheet.

Signed and Sealed this

Twenty-first Day of July, 1998

Bruce Lehman

*Attest:*

BRUCE LEHMAN

*Attesting Officer*

*Commissioner of Patents and Trademarks*